US009752802B2

(12) United States Patent
Lei et al.

(10) Patent No.: US 9,752,802 B2
(45) Date of Patent: Sep. 5, 2017

(54) REGENERATIVE REFRIGERATOR

(71) Applicant: SUMITOMO HEAVY INDUSTRIES, LTD., Shinagawa-ku (JP)

(72) Inventors: Tian Lei, Nishitokyo (JP); Mingyao Xu, Nishitokyo (JP)

(73) Assignee: SUMITOMO HEAVY INDUSTRIES, LTD., Shinagawa-Ku, Tokyo (JP)

( * ) Notice: Subject to any disclaimer, the term of this patent is extended or adjusted under 35 U.S.C. 154(b) by 199 days.

(21) Appl. No.: 14/552,803

(22) Filed: Nov. 25, 2014

(65) Prior Publication Data

US 2015/0168026 A1 Jun. 18, 2015

(30) Foreign Application Priority Data

Dec. 16, 2013 (JP) ..... 2013-259482

(51) Int. Cl.

*F25B 9/00* (2006.01)
*F25B 9/14* (2006.01)
*F25B 9/10* (2006.01)

(52) U.S. Cl.

CPC ..... *F25B 9/14* (2013.01); *F25B 9/10* (2013.01); *F25B 2309/1415* (2013.01); *F25B 2309/1418* (2013.01); *F25B 2309/1421* (2013.01); *F25B 2309/1425* (2013.01)

(58) Field of Classification Search

CPC .... F25B 9/14; F25B 9/145; F25B 2309/1415; F25B 2309/1416; F25B 9/0014

See application file for complete search history.

(56) References Cited

U.S. PATENT DOCUMENTS 4,259,844 A * 4/1981 Sarcia ..... F25B 9/14 165/10
2005/0274124 A1* 12/2005 Wang ..... F25B 9/145 62/6
2007/0130961 A1* 6/2007 Xu ..... F25B 9/14 62/6
2012/0060519 A1* 3/2012 Tanaka ..... F04B 37/08 62/55.5
2012/0227417 A1 9/2012 Chao et al.
2012/0317994 A1 12/2012 Matsubara
2013/0263607 A1 10/2013 Xu

FOREIGN PATENT DOCUMENTS

CN 101900447 A 12/2010
CN 102829574 A 12/2012
JP H03-117855 A 5/1991

(Continued)

*Primary Examiner* — Adam J Eiseman
*Assistant Examiner* — Erik Mendoza-Wilkenfe
(74) *Attorney, Agent, or Firm* — Buchanan Ingersoll & Rooney PC

(57) ABSTRACT

A first regenerator of a regenerative refrigerator includes a first regenerator member and a first cylinder accommodating the first regenerator member. A second regenerator includes a second regenerator member and a second cylinder accommodating the second regenerator member and may be connected to a low temperature end of the first regenerator. A gas pipe guides a coolant gas discharged from the first regenerator to a portion in the middle of the second regenerator. The gas pipe may include a plurality of gas relief holes in the middle of the gas pipe.

13 Claims, 6 Drawing Sheets

(56) References Cited

FOREIGN PATENT DOCUMENTS

| | | | |
|---|---|---|---|
| JP | 9-210483 | A | 8/1997 |
| JP | 2003-021414 | A | 1/2003 |
| JP | 2008-224161 | A | 9/2008 |
| JP | 2008-309452 | A | 12/2008 |
| JP | 2013-217516 | A | 10/2013 |
| JP | 2013-217517 | A | 10/2013 |

* cited by examiner

REGENERATIVE REFRIGERATOR

RELATED APPLICATION

Priority is claimed to Japanese Patent Application No. 2013-259482, filed Dec. 16, 2013, the entire content of which is incorporated herein by reference.

BACKGROUND OF THE INVENTION

1. Field of the Invention

The present invention relates to a regenerative refrigerator that uses a high pressure coolant gas supplied from a compressor to generate Simon expansion, and stores the cold using a regenerator, thereby generating the cryogenic cold.

2. Description of the Related Art

A regenerative refrigerator of displacer type causes a displacer to reciprocate in a cylinder and expands a coolant gas in an expansion space and generates the cold in this process. A regenerative refrigerator of pulse tube type causes a gas piston in a pulse tube to reciprocate and expands a coolant gas in an expanded space and generates the cold in this process. The cold of the coolant gas generated in the expansion space is stored in the regenerator and is transferred to a cooling stage, which reaches a desired ultra-low temperature and cools a cooling object connected to the cooling stage.

SUMMARY OF THE INVENTION

Embodiments of the present invention address a need to provide a technology of efficiently improving refrigeration capacity of a regenerative refrigerator.

A regenerative refrigerator according to an embodiment of the present invention includes a first regenerator including a first regenerator member and a first cylinder accommodating the first regenerator member; a second regenerator including a second regenerator member and a second cylinder accommodating the second cylinder, the second regenerator being connected to a low temperature end of the first regenerator; and a gas pipe that guides a coolant gas discharged from the first regenerator to a portion in the middle of the second regenerator.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

A description will be given of embodiments of the present invention with reference to the drawings.

First Example

A regenerative refrigerator 1 according to the first example is a cryogenic refrigerator of Gifford-McMahon type in which helium gas is used as a coolant gas. Dependence of the difference between the density of the high pressure helium gas and that of the low pressure helium on the temperature grows larger towards at an ultra-low temperature. In particular, the difference in density is maximum when the temperature is in the neighborhood of 8 K. For this reason, a large amount of helium gas is accumulated in a region in the regenerator at the temperature of around 8 K. As a result, the pressure difference in the refrigerator as a whole may be reduced so that the refrigeration capacity drops.

Figure 1:
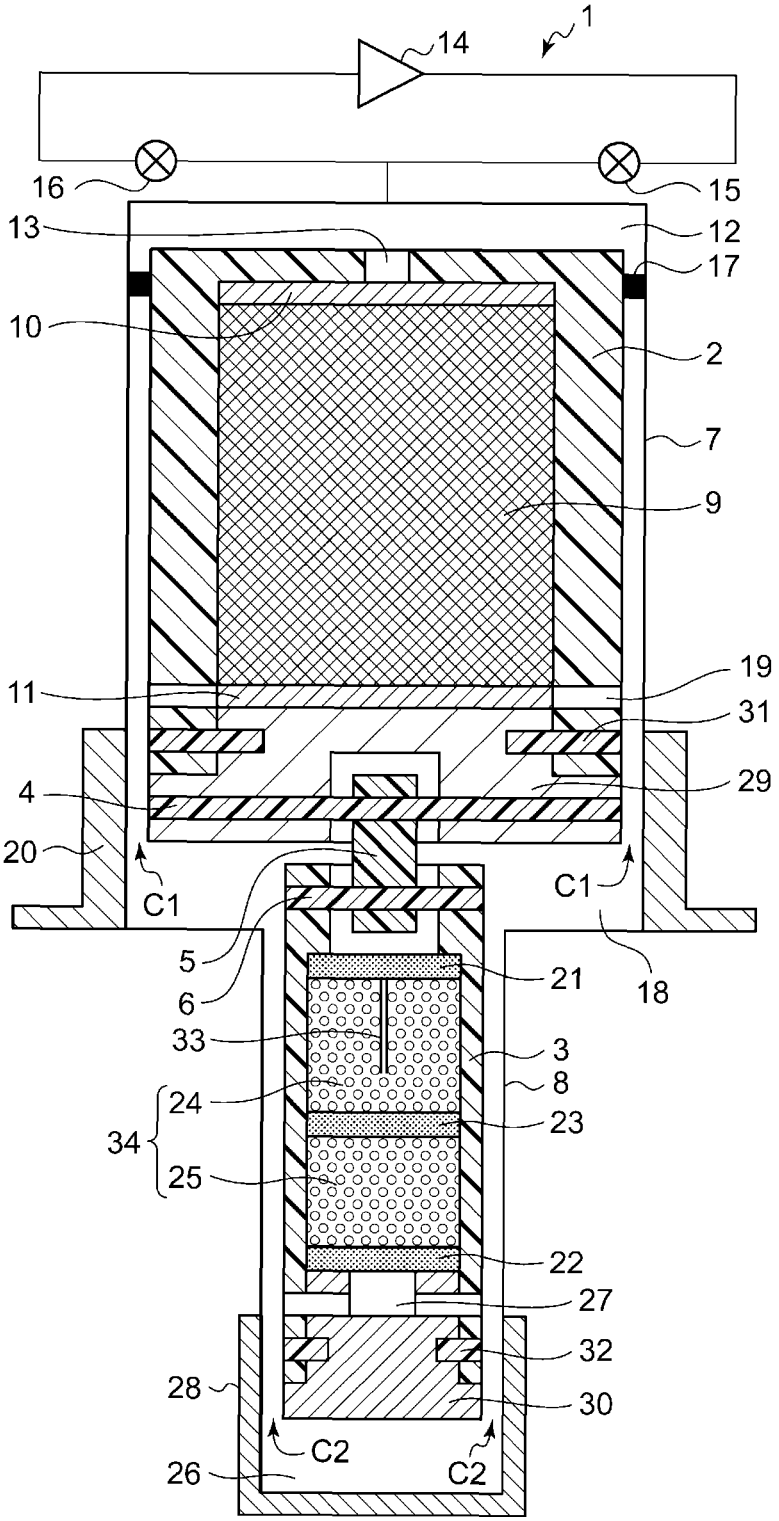
FIG. 1 schematically shows the regenerative refrigerator and the regenerator according to the first example.

As shown in FIG. 1, the regenerative refrigerator 1 includes a first displacer 2 and a second displacer 3 connected with the first displacer 2 in the longitudinal direction. The first displacer 2 and the second displacer 3 are connected via, for example, a pin 4, a connector 5, and a pin 6.

A first cylinder 7 and a second cylinder 8 are formed so as to be integrated. Each of the first and second cylinders 7 and 8 includes a high temperature end and a low temperature end. The low temperature end of the first cylinder 7 is connected to the high temperature end of the second cylinder 8 at the bottom of the first cylinder 7. The second cylinder 8 is formed so as to extend coaxially from the first cylinder 7 and is a cylindrical member having a smaller diameter than that of the first cylinder 7. The first cylinder 7 accommodates the first displacer 2 such that the first displacer 2 can reciprocate in the longitudinal direction. The second cylinder 8 accommodates the second displacer 3 such that the second displacer 3 can reciprocate in the longitudinal direction.

For example, stainless steel is used to form the first cylinder 7 and the second cylinder 8 for reasons of strength, heat conductivity, helium shielding capability, etc. The outer circumference of the second displacer 3 is a metallic cylinder formed by, for example, stainless steel. A coating film of abrasion-resistant resin such as fluorine resin may be formed on the outer circumference of the second displacer 3.

The high temperature end of the first cylinder 7 includes a Scotch-yoke mechanism (not shown) that sets the first displacer 2 and the second displacer 3 into reciprocating movement. The first displacer 2 and the second displacer 3 reciprocate along the first cylinder 7 and the second cylinder 8, respectively. Each of the first displacer 2 and the second displacer 3 includes a high temperature end and a low temperature end.

The first displacer 2 has a cylindrical outer circumferential surface. A first regenerator member fills a space inside the first displacer 2. The internal volume of the first displacer 2 functions as a first regenerator 9. Upstream of the first regenerator 9 is provided a flow straightener 10, and downstream is provided a flow straightener 11. The high temperature end of the first displacer 2 is formed with a first opening 13 that guides a coolant gas from a room temperature chamber 12 to the first displacer 2.

The room temperature chamber 12 is space defined by the high temperature ends of the first cylinder 7 and the first displacer 2 and changes its volume in association with the reciprocating movement of the first displacer 2. A common suction and discharge piping, which is one of the pipes forming the suction and discharge system comprised of a compressor 14, a supply valve 15, and a return valve 16, is connected to the room temperature chamber 12. A seal 17 is fitted between a portion of the first displacer 2 toward the high temperature end and the first cylinder 7.

A second opening 19 for introducing the coolant gas into a first expansion space 18 via a first clearance C1 is formed at the low temperature end of the first displacer 2. The first expansion space 18 is a space defined by the first cylinder 7 and the first displacer 2 and changes its volume in association with the reciprocating movement of the first displacer 2. A first cooling stage 20 thermally coupled to a cooling object (not shown) is placed at a position in the outer circumference of the first cylinder 7 corresponding to the first expansion space 18. The first cooling stage 20 is cooled by the coolant gas flowing through the first clearance C1.

The second displacer 3 has a cylindrical outer circumferential surface. The interior space of the second displacer 3 is divided into two stages in the axial direction, one of the stages being sandwiched by a flow straightener 21 at the upper end and a partition member 23 located in the middle in the vertical direction, and the other stage being sandwiched by the partition member 23 and a flow straightener 22 at the lower end. A high temperature region 24 in the interior volume of the second displacer 3 more toward the high temperature end than the partition member 23 is filled by a second regenerator member formed by a non-magnetic material such as lead or bismuth. A low temperature region 25 more toward the low temperature (lower) end than the partition member 23 is filled by a second regenerator member different from that of the high temperature region (e.g., a regenerator formed by a magnetic material such as HoCu2). Lead, bismuth, HoCu2, etc. are formed into spheres. A plurality of spheres are aggregated to build a regenerator member. The partition member 23 prevents the regenerator member in the high temperature region 24 and the regenerator member in the low temperature region 25 from being mixed. The high temperature region 24 and the low temperature region 25 (the internal volume of the second displacer 3) function as a second regenerator 34. The first expansion space 18 and the high end of the second displacer 3 communicate with each other via a communication passage around the connector 5. The coolant gas flows from the first expansion space 18 to the second regenerator 34 via the communication passage.

A third opening 27 for introducing the coolant gas into a second expansion space 26 via a second clearance C2 is formed at the low temperature end of the second displacer 3. The second expansion space 26 is a space defined by the second cylinder 8 and the second displacer 3 and changes its volume in association with the reciprocating movement of the second displacer 3. The second clearance C2 is formed by the low temperature end of the second cylinder 8 and the second displacer 3.

A second cooling stage 28 thermally coupled to a cooling object is placed at a position in the outer circumference of the second cylinder 8 corresponding to the second expansion space 26. The second cooling stage 28 is cooled by the coolant gas flowing through the second clearance C2.

For example, phenolic fabric is used for the first displacer 2 for reasons of specific weight, strength, heat conductivity, etc. The first regenerator member is built by, for example, a metal wire mesh. The second displacer 3 is built by using felts and a metal wire mesh to sandwich the second regenerator member formed by lead or bismuth spheres in the axial direction. The internal volume of the second displacer 3 may be divided into a plurality of regions by a partition member as described above.

The first and second displacers 2 and 3 may include heat exchangers 29 and 30, respectively, at the low temperature ends. For proper joint with the displacer body, the heat exchangers 29 and 30 have a shape of a stepped column. The heat exchanger 29 is secured to the first displacer 2 by a pin 31, and the heat exchanger 30 is secured to the second displacer 3 by a pin 32. This substantially increases an area of heat exchange in both the first cooling stage 20 and the second cooling stage 28 and so improves the cooling efficiency.

As shown in FIG. 1, the regenerative refrigerator 1 according to the first example further includes a gas pipe 33 that guides the coolant gas discharged from the first regenerator 9 to a portion in the middle of the second regenerator. More specifically, the gas pipe 33 guides the coolant gas discharged from the first regenerator 9 to the high temperature region 24 of the second regenerator.

The gas pipe 33 is embedded in the non-magnetic second regenerator member in the high temperature region 24. As is clear from FIG. 1, the high temperature end of the gas pipe 33 is located more toward the low temperature end than the lower end of the first cooling stage 20, and the low temperature end of the gas pipe 33 is located more toward the high temperature end than the upper end of the second cooling stage 28.

The axial position of the gas pipe 33 in the high temperature region 24 is determined by allowing for the temperature profile of the second regenerator in normal operation of the regenerative refrigerator 1. The position of embedding the gas pipe 33 will be discussed in further detail below. In ordinary cryogenic refrigerators, the low temperature end of the gas pipe 33 is preferably spaced apart from the partition member 23 toward the high temperature end by a predetermined distance. The high temperature end of the gas pipe 33 may penetrate the flow straightener 21. The gas pipe 33 may include a support member to maintain the axial position in the high temperature region 24 (not shown in FIG. 1). For example, the low temperature end of the gas pipe 33 may include a cross-shaped support member.

A description will now be given of the operation of the regenerative refrigerator 1 according to the first example. At a point of time during the step of supplying a coolant gas, the first and second displacers 2 and 3 are located at the bottom dead point of the first and second cylinders 7 and 8, respectively. When the supply valve 15 is opened concurrently or at a slightly shifted point of time, a high pressure helium gas is supplied from the common suction and discharge piping to the interior space of the first cylinder 7 via the supply valve 15 and flows into the first regenerator 9 in the first displacer 2 via the first opening 13 located at the top of the first displacer 2. The high pressure helium gas flowing into the first regenerator 9 is cooled by the first regenerator member and is supplied to the first expansion space 18 via the second opening 19 located toward the bottom of the first displacer 2 and the first clearance C1.

The high pressure helium gas supplied to the first expansion space 18 flows into the second regenerator 34 in the second displacer 3 via the communication passage around the connector 5. The high pressure helium gas flowing into the second regenerator 34 is cooled by the second regenerator member and is supplied to the second expansion space 26 via the third opening 27 located toward the bottom of the second displacer 3 and the second clearance.

Thus, the first expansion space 18 and the second expansion space 26 are filled with the high pressure helium gas, whereupon the supply valve 15 is closed. At this stage, the first and second displacers 2 and 3 are located at the top dead point of the first and second cylinders 7 and 8, respectively. By opening the return valve 16 concurrently or at a slightly shifted point of time, the pressure of the coolant gas in the first and second expansion spaces 18 and 26 is reduced so that the gas is expanded. The helium gas in the first expansion space 18 cooled as a result of expansion absorbs the heat of the first cooling stage 20 via the first clearance C1, and the helium gas in the second expansion space 26 absorbs the heat of the second cooling stage 28 via the second clearance C2.

The first and second displacers 2 and 3 are moved toward the bottom dead point and the volume of the first and second expansion spaces 18 and 26 is reduced. The helium gas in the second expansion space 26 is returned to the first expansion space 18 via the second clearance C2, the third opening 27, the second regenerator 34, and the communication passage. Further, the helium gas in the first expansion space 18 is returned to the suction side of the compressor 14 via the second opening 19, the first regenerator 9, and the first opening 13. In this process, the first and second regenerator members are cooled by the coolant gas. The regenerative refrigerator 1 repeats this cooling cycle described above to cool the first and second cooling stages 20 and 28.

As described above, the cooling cycle of the regenerative refrigerator 1 includes causing the coolant helium gas to flow into and out of the second regenerator repeatedly. A description will be given of the temperature profile and mass change of the helium gas located in the second regenerator.

Figure 2:
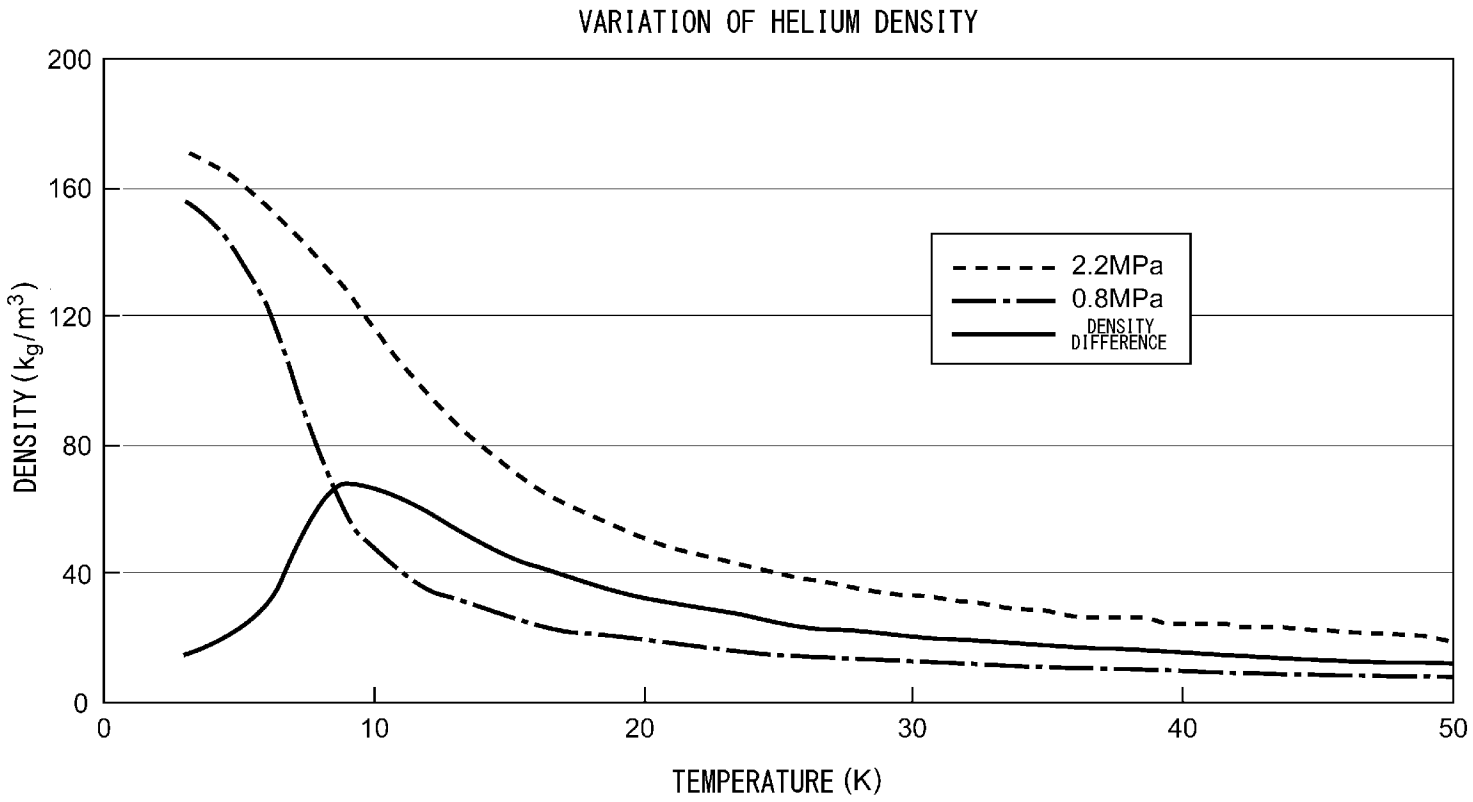
FIG. 2 is a graph showing variation of the density of a 2.2 MPa helium gas and that of a 0.8 MPa helium gas with temperature and variation of the density difference between the gases with temperature.

FIG. 2 is a graph showing variation of the density of a 2.2 MPa helium gas and that of a 0.8 MPa helium gas with temperature and variation of the density difference between the gases with temperature. As shown in FIG. 2, the density difference between the 2.2 MPa helium gas and the 0.8 MPa helium gas is maximum when the temperature is about 8 K. When the temperature of the helium gas is lower than 8K, the density difference between the 2.2 MPa helium gas and the 0.8 MPa helium gas monotonously increases with temperature. When the temperature of the helium gas is higher than 8 K, the density difference monotonously decreases with temperature.

The mass of helium gas located in the second regenerator 34 will be denoted by M. The mass of helium gas flowing into the high temperature end of the second regenerator 34, i.e., the flow straightener 21 at the upper end of the second regenerator 34 per unit time will be denoted by $m_{in}$, and the mass of helium gas flowing out of the flow straightener 22 at the lower end of the second regenerator 34 per unit time will be denoted by $m_{out}$. When the helium gas flows into the second regenerator 34, the mass M of the helium gas located in the second regenerator 34 is increased. Meanwhile, when the helium gas flows out of the second regenerator 34, the mass M of the helium gas located in the second regenerator 34 is decreased. Therefore, variation dM/dt in the mass M of helium gas located in the second regenerator 34 per unit time is represented by the difference between the mass flowing in $m_{in}$ and the mass flowing out $m_{out}$. Based on the foregoing, the following expression (1) is obtained.

$$m_{in}-m_{out}=dM/dt \tag{1}$$

where dM/dt denotes the derivative of the mass M of helium gas located in the second regenerator 34 with respect to time t.

As described above, the second regenerator 34 is provided in the second displacer 3. The second displacer 3 is built by using felts and a metal wire mesh to sandwich the second regenerator member formed by lead or bismuth spheres in the axial direction. Accordingly, the volume of the second regenerator 34 is considered to be constant. The volume will be denoted by V. Given that the average density of helium gas in the second regenerator 34 is denoted by ρ, the mass M of the coolant gas located in the second regenerator 34 is given by the following expression (2).

$$M=V\rho \tag{2}$$

Substituting expression (2) into expression (1), we obtain the following expression (3).

$$m_{in}-m_{out}=Vd\rho/dt \tag{3}$$

where dρ/dt denotes the time derivative of the density ρ of helium gas.

Assuming that the density of helium gas flowing into the second regenerator 34 remains unchanged over time, $m_{in}-m_{out}=0$, indicating that the mass M of helium gas located in the second regenerator 34 remains unchanged. It means that the helium gas flows out of the second regenerator 34 in an amount equal to the amount flowing into the second regenerator 34. When the supply valve 15 is opened in an actual cooling cycle, a high pressure helium gas is supplied via the supply valve 15. As a result, the high pressure helium gas flows also into the second regenerator 34, increasing the pressure of the low pressure helium gas filling the second regenerator 34 so as to turn it into a high pressure helium gas.

As shown in FIG. 2, the high pressure helium gas and the low pressure helium gas differ in the density. Accordingly, when the high pressure helium gas flows into the second regenerator 34 and increases the pressure of the low pressure helium gas inside so as to turn it into a high pressure helium gas, the right side of expression (3) will assume a positive value. More specifically, the right side of expression (3) represents the density difference indicated by the solid line in FIG. 2. Based on the foregoing, we obtain the following expression (4).

$$m_{in}-m_{out}=Vd\rho/dt>0 \tag{4}$$

As described above, the high pressure helium gas flowing into the second regenerator 34 is cooled by the second regenerator member and is supplied to the second expansion space 26 via the third opening 27 located toward the bottom of the second displacer 3 and the second clearance. However, expression (4) above shows that the mass of helium gas flowing from the second regenerator to the second expansion space 26 is smaller than the mass of helium gas flowing into the second regenerator. This means that the second regenerator 34 functions as if it is a buffer of helium gas. As a result, pressure drop in the second expansion space 26 is mitigated and the pressure difference is maintained small.

When the return valve 16 is opened, the high pressure helium gas in the second regenerator 34 will turn into a low pressure helium gas. When this occurs, the right side of expression (3) will assume a negative value, the absolute value thereof being the values of density difference represented by the solid line in FIG. 2. We therefore obtain the following expression (5).

$$m_{in}-m_{out}=Vd\rho/dt<0 \tag{5}$$

This shows that the mass of helium gas flowing out of the second regenerator 34 is larger than the mass of helium gas flowing from the second expansion space 26 to the second regenerator 34.

Figure 3:
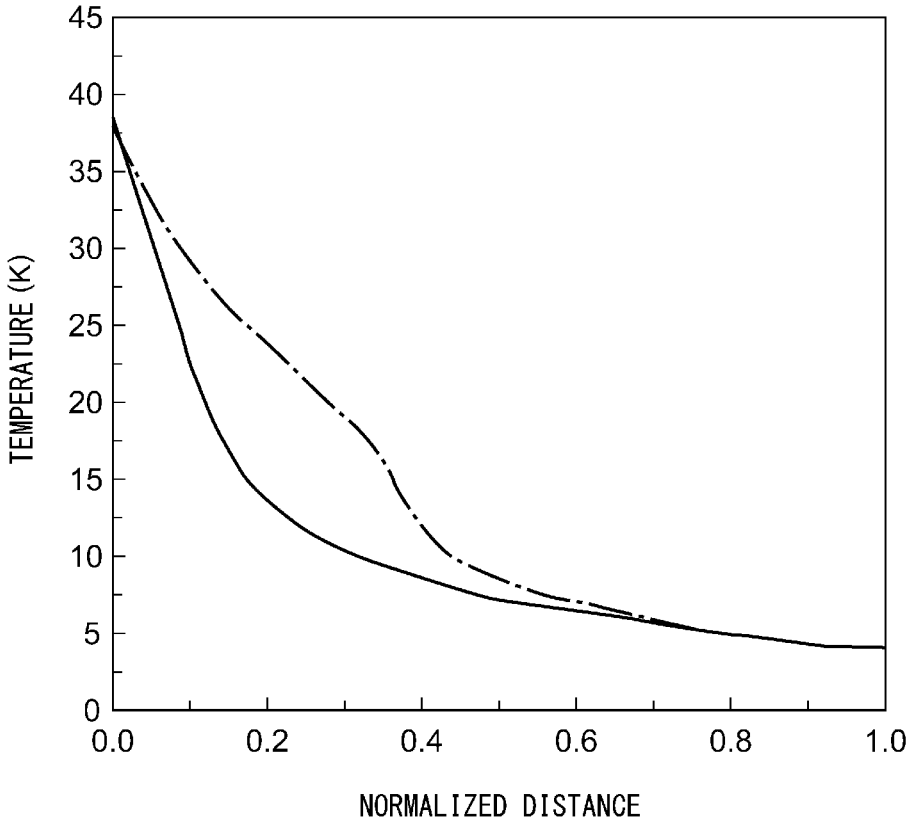
FIG. 3 shows an exemplary temperature profile of the second regenerator according to the first example.

FIG. 3 shows an exemplary temperature profile of the second regenerator according to the first example. FIG. 3 is a graph showing the temperature profile of the second regenerator 34 obtained given that the distance from the high temperature end of the second regenerator to the low temperature end is defined as 1. Referring to FIG. 3, the graph of solid line represents the temperature distribution of the second regenerator 34 according to the related art, i.e., the temperature distribution of the second regenerator not including the gas pipe 33.

As indicated by the solid line of FIG. 3, the temperature profile of the second regenerator 34 of the dual stage refrigerator according to the related art from the high temperature end toward the low temperature is approximately inversely proportional to the distance from the high temperature end. The graph approximates a hyperbolic curve. Referring to FIG. 3, the temperature gradient is largest at a location where the normalized distance is about 0.2, which is located in the high temperature region 24. When the normalized distance is near 0.2, the temperature is about 8 K, which agrees with the temperature at which the density difference in FIG. 2 is maximum. This means that, by warming the helium gas in the region in the second regenerator according to the related art where the temperature of the helium gas is 8 K and by causing the temperature profile of the second regenerator to approximate a straight line accordingly, increase in the density difference of the helium gas is mitigated and the refrigeration capacity of the refrigerator as a whole is improved as a result.

In this consequence, the second regenerator 34 according to the first example includes the gas pipe 33 that guides the coolant gas discharged from the first regenerator 9 to the first expansion space 18 to a portion in the middle of the second regenerator 34. Given that the length of the second regenerator 34 is 1, the exit of the gas pipe 33 toward the low temperature end is located at a position distanced 0.2-0.3 from the high temperature end of the second regenerator 34. This ensures that the helium gas in the first expansion space 18 (where the helium gas is at about 50 K) is supplied to the region where the temperature of helium gas is about 8 K in the absence of the gas pipe 33. Consequently, the temperature profile of the second regenerator can approximate a straight line. In this specification, an attempt of causing the temperature profile of the second regenerator to approximate a straight line may be referred to as "improvement of the temperature profile".

Referring to FIG. 3, the dashed-dotted line is a graph of the temperature profile of the second regenerator 34 including the gas pipe 33 according to the first example. As shown in FIG. 3, the temperature profile of the second regenerator 34, and, in particular, the high temperature region 24, is improved by providing a bypass of helium gas in the middle of the second regenerator 34 by using the gas pipe 33. Increase in the temperature profile in the high temperature region 24 reduces the amount of helium gas accumulated in this region and increases the pressure difference in the refrigerator system as a whole so that the refrigeration capacity is increased.

In the axial region where the end of the gas pipe 33 toward the second regenerator is located, the specific heat of the coolant helium gas exceeds the specific heat of the second regenerator member formed by a non-magnetic material. Further, the temperature of the region is confined within a temperature range of, for example, 8-20 K (more preferably, 8-10 K) during the operation of the refrigerator. Non-magnetic materials like lead and bismuth exemplify a regenerator member material having a high specific heat in this temperature range.

Figure 4A:
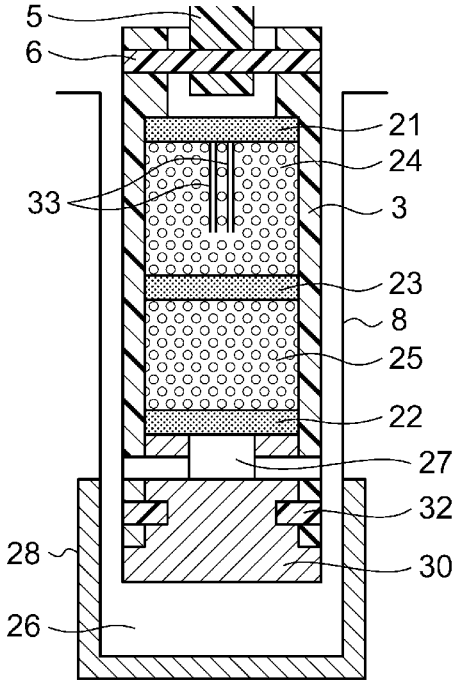
FIGS. 4A-4D show alternative examples of the gas pipe according to the first example.

FIGS. 4A-4D show alternative examples of the gas pipe 33 according to the first example. FIG. 4A shows the second regenerator 34 including a plurality of gas pipes 33. As mentioned above, the second regenerator includes a plurality of metal spheres. Therefore, the inner diameter of the gas pipe 33 is preferably smaller than the diameter of the metal spheres and, more specifically, 0.3 mm or smaller. This reduces the likelihood that the gas pipe 33 is clogged by the regenerator member. Further, by providing a plurality of gas pipes 33, the amount of helium gas guided to a portion in the middle of the second regenerator is increased.

A mesh with openings having a diameter smaller than that of the regenerator member may be provided at the end of each gas pipe 33 toward the second regenerator. This can efficiently reduce the likelihood that the gas pipe 33 is clogged by the regenerator member.

Figure 4B:
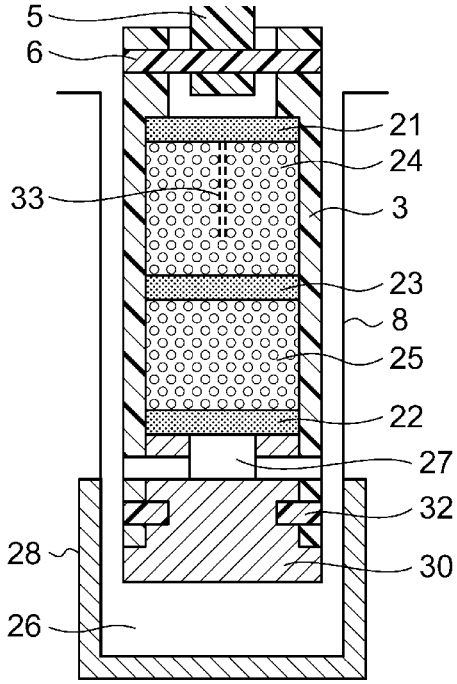

FIG. 4B shows the gas pipe 33 including a plurality of gas relief holes in the middle of the pipe. Because there are a plurality of gas relief holes in the middle of the pipe, the helium gas flowing in the gas pipe 33 shown in FIG. 4B flows into the second regenerator 34 via a portion of the second regenerator 34 at a relatively high temperature as well as via a portion at a relatively low temperature. As compared with the case where the helium gas is discharged only at the end of the gas pipe 33, the temperature difference between the helium gas in the second regenerator 34 and the helium gas bypassed by the gas pipe 33 is reduced. This can reduce entropy loss created when volumes of helium gas at different temperatures are mixed.

Figure 4C:
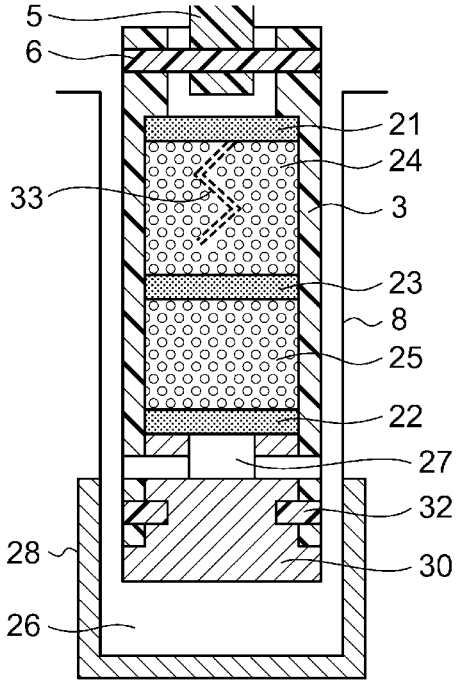

FIG. 4C shows the gas pipe 33 curved in zigzag form. As in the case shown in FIG. 4B, the gas pipe 33 shown in FIG. 4C also includes a plurality of gas relief holes in the middle of the pipe. Coupled with the fact that the pipe includes multiple zigzag bends, the provision bypasses the helium gas in a more extensive range in the second regenerator than 34 in the case shown in FIG. 4B. This improves the temperature profile of the second regenerator 34 more efficiently.

FIGS. 4B and 4C show only one gas pipe 33, but a plurality of gas pipes 33 as shown in FIG. 4A may be provided.

Figure 4D:
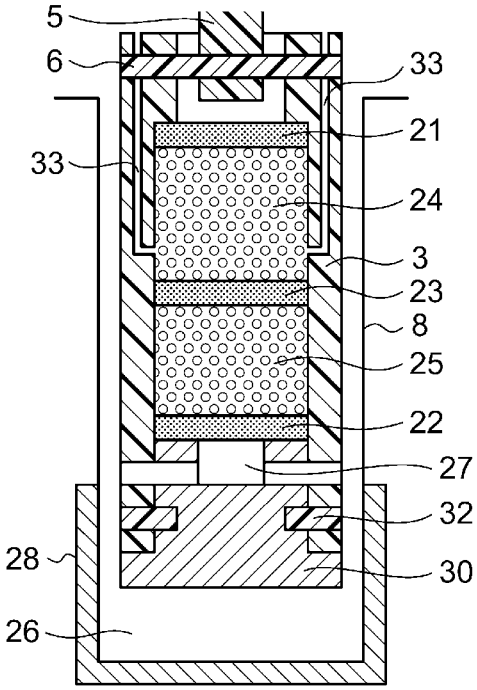

FIG. 4D shows a case where the gas pipe 33 is provided in the wall of the second displacer 3. As compared with the above-described cases, the illustrated arrangement is advantageous in that the helium gas discharged from the first regenerator 9 is guided to a portion in the middle of the second regenerator 34 without reducing the size of the regenerator member because the gas pipe 33 is not located in the second regenerator 34.

Second Example

The first example described above is is applied to a refrigerator of displacer type. The example can also be applied to a refrigerator of pulse tube type. Application to a refrigerator of pulse tube type will be described as the second example.

Figure 5:
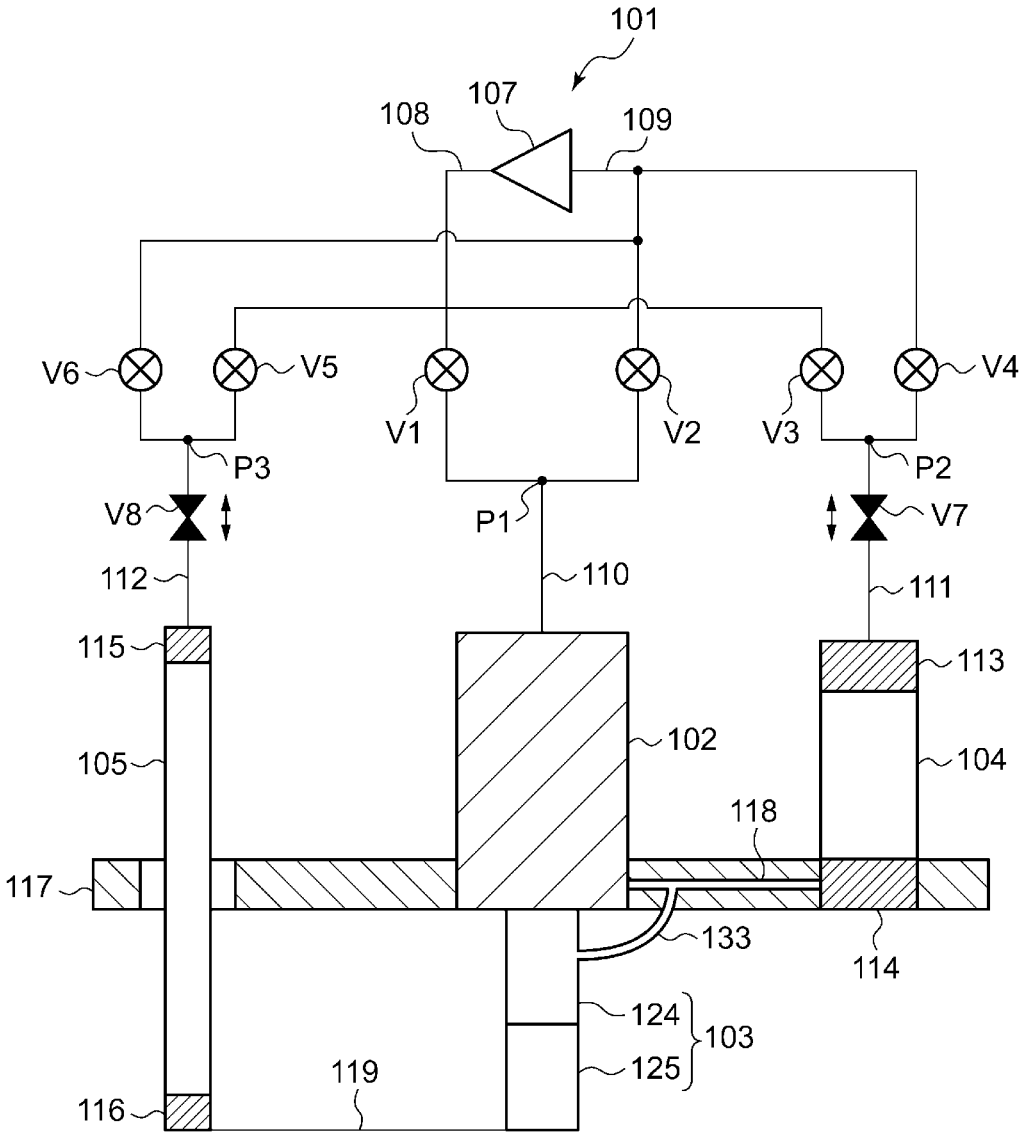
FIG. 5 schematically shows the regenerative refrigerator of pulse tube type according to the second example.

FIG. 5 schematically shows a regenerative refrigerator 101 of pulse tube type according to the second example. The regenerative refrigerator 101 of pulse tube type according to the second example includes a first regenerator 102, a second regenerator 103, a first pulse tube 104, and a second pulse tube 105. The high temperature ends of the first regenerator 102, the first pulse tube 104, and the second pulse tube 105 are connected to a branching pipe 108 coupled to the discharging side of a compressor 107 and having three branches and to a branching pipe 109 coupled to the suction side of the compressor 107 and having three branches, via a first common suction and discharge pipe 110 corresponding to the high temperature end of the first regenerator 102, a second common suction and discharge pipe 111 corresponding to the high temperature end of the first pulse tube 104, and a third common suction and discharge pipe 112 corresponding to the second pulse tube 105, respectively.

A regenerator supply valve V1 is provided before a first node P1 connecting the branching pipe 108 to the first common suction and discharge pipe 110. A first supply valve V3 is provided before a second node P2 connecting the branching pipe 108 to the second common suction and discharge pipe 111. Further, a second supply valve V5 is provided before a third node P3 connecting the branching pipe 108 to the third common suction and discharge pipe 112.

A regenerator return valve V2 is provided before the first node P1 connecting the branching pipe 109 to the first common suction and discharge pipe 110. A first return valve V4 is provided before the second node P2 connecting the branching pipe 109 to the second common suction and discharge pipe 111. A second return valve V6 is provided before the third node P3 connecting the branching pipe 109 to the third common suction and discharge pipe 112.

A flow rate control valve V7 is provided in the second common suction and discharge pipe 111 between the high temperature end of the first pulse tube 104 and the second node P2. A flow rate control valve V8 is provided in the third common suction and discharge pipe 112 between the high temperature end of the second pulse tube 105 and the third node P3. These flow rate control valves function as a mechanism to adjust the phases of the gas piston that occur in the pulse tubes. An orifice may be used instead of the flow rate control valve.

A first flow straightener and heat exchanger 113 is provided at the high temperature end of the first pulse tube 104, and a second flow straightener and heat exchanger 114 is provided at the low temperature end thereof. A third flow straightener and heat exchanger 115 is provided at the high temperature end of the second pulse tube 105, and a fourth flow straightener and heat exchanger 116 is provided at the low temperature end.

The low temperature end of the first pulse tube 104 and the low temperature end of the first regenerator 102 are thermally coupled by a cooling stage 117. A first low temperature end connecting pipe 118 located inside the cooling stage 117 connects the low temperature end of the first pulse tube 104 and the low temperature end of the first regenerator 102 so as to allow the coolant gas to flow therethrough. A second low temperature end connecting pipe 119 connects the low temperature end of the second pulse tube 105 and the low temperature end of the second regenerator 103 so as to allow the coolant gas to flow therethrough.

As in the case of the second regenerator according to the first example, the interior space of the second regenerator 103 of the regenerative refrigerator 101 according to the second example includes a high temperature region 124 in the upper half and a low temperature region 125 in the lower half, the high temperature region 124 including a non-magnetic member, and the low temperature region 125 including a regenerator member formed by a magnetic material. The high temperature region 124 and the low temperature region 125 form the second regenerator 103.

When the first supply valve V3 and the second supply valve V5 of the regenerative refrigerator 101 of pulse tube type configured as described above are opened in a cycle of supplying a high pressure coolant gas, the coolant gas flows to the low temperature ends of the first pulse tube 104 and the second pulse tube 105 via the branching pipe 108, and the second common suction and discharge pipe 111 or the third common suction and discharge pipe 112.

Further, when the regenerator supply valve V1 is opened, the coolant gas from the compressor 107 flows through the branching pipe 108 and the first common suction and discharge pipe 110, flows from the first regenerator 102 to the low temperature end of the first pulse tube 104, and also flows the second regenerator 103 to the high temperature end of the second pulse tube 105.

Meanwhile, when the first return valve V4 or the second return valve V6 is opened in a step of collecting a low pressure coolant gas, the coolant gas in the first pulse tube 104 or the second pulse tube 105 flows from the high temperature end of the first pulse tube 104 or the second pulse tube 105 through the second common suction and discharge pipe 111 or the third common suction and discharge pipe 112, and the branching pipe 109, before being collected by the compressor 107. When the regenerator return valve V2 is opened, the coolant gas in the first pulse tube 104 flows out of the low temperature end and is collected by the compressor 107 via the first regenerator 102, the first common suction and discharge pipe 110, and the branching pipe 109. Similarly, the coolant gas in the second pulse tube 105 is collected by the compressor 107 via the second regenerator 103, the first regenerator 102, the first common suction and discharge pipe 110, and the branching pipe 109.

According to the regenerative refrigerator 101 of pulse tube type according to the second example, the cold is generated at the low temperature end of the regenerator and the pulse tubes by repeating the operation in which a coolant gas such as helium gas (operating fluid) compressed by the compressor 107 flows to the first regenerator 102, the second regenerator 103, the first pulse tube 104, and the second pulse tube 105, and the operation in which the operating fluid flows out of the first pulse tube 104, the second pulse tube 105, the first regenerator 102, and the second regenerator 103 and is collected by the compressor 107. By causing a cooling object to contact the low temperature ends of the regenerators and the pulse tubes thermally, heat is released from the cooling object.

The regenerative refrigerator 101 of pulse tube type according to the second example includes a gas pipe 133 that branches from a portion in the middle of the first low temperature end connecting pipe 118, which causes the coolant gas to flow between the low temperature end of the first regenerator 102 and the low temperature end of the first pulse tube 104, and that guides the coolant gas to a portion in the middle of the second regenerator 103. The gas pipe 133 guides a portion of the coolant gas discharged from the first regenerator 102 and flowing through the first low temperature end connecting pipe 118 to a portion in the middle of the second regenerator 103.

The gas pipe 133 is joined to the second regenerator 103 in the high temperature region 124 of the second regenerator 103 which contains a non-magnetic material. In the axial region of the second regenerator 103 where the joint is located, the specific heat of the coolant helium gas exceeds the specific heat of the regenerator member formed by a non-magnetic material. Further, the temperature of the region is confined within a temperature range of, for example, 8-20 K (more preferably, 8-10 K) during the operation of the refrigerator.

The regenerative refrigerator 101 according to the second example provides the following advantages. That is, as described above in the first example, shifting of the intermediate region of the temperature profile spanning the high temperature end and the low temperature end of the regenerator in the upper stage toward the high temperature side results in reduction in the amount of helium gas accumulated in the region and increase in the pressure difference in the refrigerator system as a whole so that the refrigeration capacity is increased.

Figure 6B:
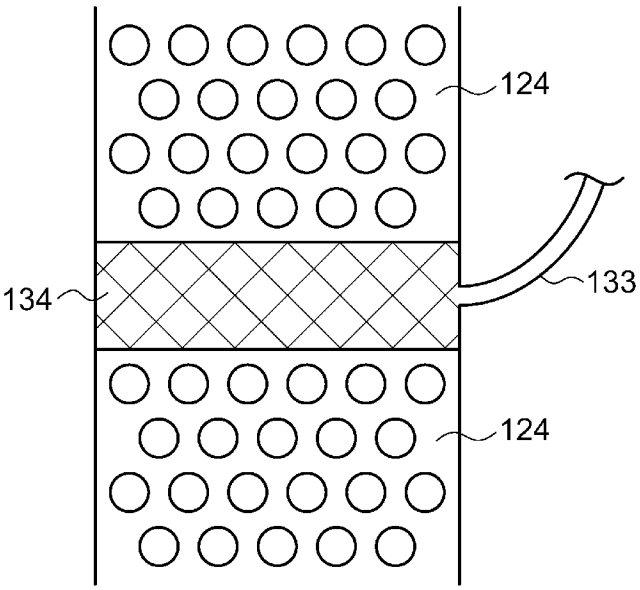
FIGS. 6A-6B show another example of the gas tube included in the regenerative refrigerator according to the second example.
Figure 6A:
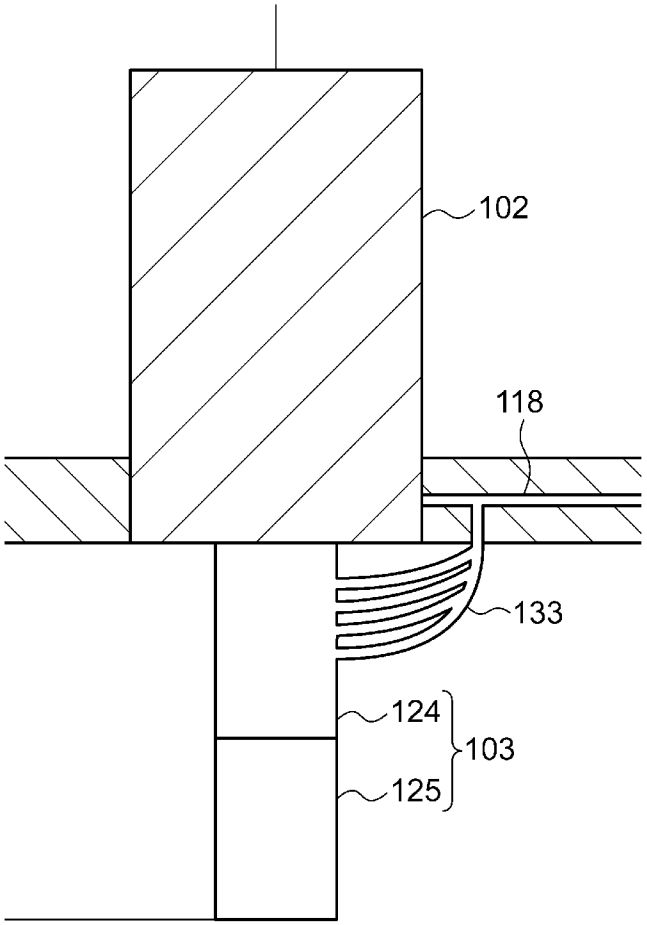

FIGS. 6A-6B show alternative examples of the gas pipe 133 provided in the regenerative refrigerator 101 according to the second example. More specifically, FIG. 6A shows the gas pipe 133 including a plurality of branches and capable of bypassing the coolant gas to a plurality of locations. FIG. 6B shows the connection between the gas pipe 133 and the second regenerator 103 in further detail.

As shown in FIG. 6A, the coolant gas flows into the second regenerator 103 via a portion of the second regenerator 103 at a relatively high temperature as well as via a portion at a relatively low temperature, by using the gas pipe 133 including a plurality of branches. As compared with the case where the helium gas is discharged only at the end of the gas pipe 133, the temperature difference between the helium gas in the second regenerator 103 and the helium gas bypassed by the gas pipe 133 is reduced. This can reduce entropy loss created when volumes of helium gas at different temperatures are mixed and achieve the same advantage as available from the gas pipe 33 shown in FIG. 4A.

The gas pipe 133 according to the second example guides a portion of the coolant gas flowing in the first low temperature end connecting pipe 118 to the high temperature region 124 of the second regenerator 103 including a non-magnetic member. The non-magnetic member provided in the high temperature region 124 is formed as spheres. As shown in FIG. 6B, the joint of the gas pipe 133 to the high temperature region 124 includes a wire mesh having a mesh size smaller than the diameter of the non-magnetic member. This reduces the likelihood that the gas pipe 33 is clogged by the regenerator member.

Preferred embodiments of the invention are described above in detail. The embodiments are not limited to those described above and various modifications or replacements are possible without departing from the scope of the invention.

The two-stage regenerative refrigerator is described above by way of example. Alternatively, the refrigerator may include three or more stages. The GM regenerative refrigerator of displacer type or pulse tube type are described above by way of example, but the description is non-limiting as to the type of refrigerator. For example, the embodiments can be applied to Stirling refrigerators, Solvay refrigerators, etc.

It should be understood that the invention is not limited to the above-described embodiment, but may be modified into various forms on the basis of the spirit of the invention. Additionally, the modifications are included in the scope of the invention.

What is claimed is:

1. A regenerative refrigerator comprising:

a first regenerator including a first regenerator member and a first cylinder accommodating the first regenerator member;

a second axially extending regenerator including a second regenerator member and a second cylinder accommodating the second regenerator member, the second axially extending regenerator being connected to a low temperature end of the first regenerator, the second regenerator member formed of spheres, an internal volume of the second axially extending regenerator filled with the second regenerator member; and a bypass gas pipe extending partway within the internal volume along the second axially extending regenerator for guiding a coolant gas discharged from the first regenerator to an axially middle portion of a high temperature region of the second regenerator member.

2. The regenerative refrigerator according to claim 1, wherein the spheres located in the high temperature region of the second regenerator member are formed by a non-magnetic material and the spheres located in a low temperature region of the second regenerator member are formed by a magnetic material, and a distal end of the bypass gas pipe toward the second axially extending regenerator is located in the high temperature region.

3. The regenerative refrigerator according to claim 1, wherein a middle of the bypass gas pipe includes a plurality of gas relief holes.

4. The regenerative refrigerator according to claim 1, wherein the spheres of the second regenerator member are formed of metal, and an inner diameter of the bypass gas pipe is smaller than the diameter of the metal spheres.

5. The regenerative refrigerator according to claim 1, wherein a mesh is provided at an end of the bypass gas pipe toward the second axially extending regenerator.

6. The regenerative refrigerator according to claim 1, wherein the first cylinder includes a first displacer accommodating the first regenerator member, the first displacer is accommodated such that the first displacer can reciprocate in the first cylinder in a longitudinal direction and forms an expansion space for expansion of a coolant gas between the first displacer and a low temperature end of the first cylinder, the second cylinder includes a second displacer accommodating the second regenerator member, and the bypass gas pipe extends within a wall of the second displacer and is located outside the second regenerator member for guiding the coolant gas from the expansion space to the axially middle portion of the second axially extending regenerator.

7. A regenerative refrigerator comprising:

a first regenerator including a first regenerator member and a first cylinder accommodating the first regenerator member;

a second axially extending regenerator including a second regenerator member and a second cylinder accommodating the second regenerator member, the second axially extending regenerator being connected to a low temperature end of the first regenerator;

a bypass gas pipe extending to an axially middle portion of the second axially extending regenerator such as to guide a coolant gas discharged from the first regenerator to the axially middle portion of the second axially extending regenerator;

a compressor that compresses a coolant gas;

a first pulse tube including a high temperature end connected to the compressor and a low temperature end; and a low temperature end connecting pipe that connects the low temperature end of the first pulse tube and a low temperature end of the first cylinder, wherein the bypass gas pipe comprises a branch branching at a middle of the low temperature end connecting pipe and connecting a middle of the low temperature end connecting pipe to the axially middle portion of the second axially extending regenerator for guiding a portion of the coolant gas discharged from the first regenerator and flowing through the low temperature end connecting pipe to the axially middle portion of the second axially extending regenerator.

8. The regenerative refrigerator according to claim 1, wherein the bypass gas pipe comprises a gas pipe distal end positioned within the axially middle portion of the second axially extending regenerator.

9. The regenerative refrigerator according to claim 8, wherein the bypass gas pipe distal end is embedded in the second regenerator member.

10. The regenerative refrigerator according to claim 9, wherein the bypass gas pipe comprises a high temperature end being opposite to the gas pipe distal end, the high temperature end of the bypass gas pipe is also embedded in the second regenerator member.

11. The regenerative refrigerator according to claim 9, wherein the bypass gas pipe comprises a high temperature end being opposite to the gas pipe distal end, the high temperature end of the bypass gas pipe is arranged at an axial position cooled to a temperature lower than that of a first cooling stage of the regenerative refrigerator.

12. The regenerative refrigerator according to claim 1, wherein the bypass gas pipe comprises a straight pipe surrounded by the second regenerator member.

13. The regenerative refrigerator according to claim 1, wherein the bypass gas pipe comprises a curved pipe in zigzag form.

* * * * *